United States Patent [19]

Ruhe et al.

[11] 3,957,019

[45] May 18, 1976

[54] HEAT EXCHANGERS

[75] Inventors: Anthony Ruhe, Fonthill; James H. D. Nickerson, St. Catharines, both of Canada

[73] Assignee: Foster Wheeler Limited, St. Catharines, Canada

[22] Filed: Mar. 28, 1975

[21] Appl. No.: 563,041

[30] Foreign Application Priority Data

Aug. 15, 1974 Canada ..... 207120

[52] U.S. Cl. ..... 122/32; 122/406 R; 165/160; 165/163

[51] Int. Cl.[2] ..... F22B 1/06; F22D 7/00

[58] Field of Search ..... 165/114, 159, 160, 161, 165/162, 163; 122/32, 34, 406

[56] References Cited

UNITED STATES PATENTS

| | | | |
|---|---|---|---|
| 3,139,070 | 6/1964 | Sprague et al. | 165/162 |
| 3,195,515 | 7/1965 | Blizard | 122/34 |
| 3,706,301 | 12/1972 | Penfield, Jr. | 165/114 |
| 3,804,069 | 4/1974 | Bennett | 122/34 |

*Primary Examiner*—Kenneth W. Sprague
*Attorney, Agent, or Firm*—John E. Wilson; Marvin A. Naigur

[57] ABSTRACT

U-tubes in a heat exchanger are arranged so that at intervals about the periphery of the tube bundle lanes are formed in the layout for more evenly distributing the flow of downcomer fluid through the entire bundle. Ducts are also provided for distributing downcomer fluid into upper portions of the bundle, the ducts providing a one-way communication between the downcomer area and the central portion of the bundle providing both circulation of fluids and preventing backflow of steam formed in the heat exchanger into the downcomer area. A torus header has outlet nozzles communicating with the lower portion of the heat exchanger which header introduces makeup water to the exchanger which is directed through the nozzles at the top surface of the tube sheet for reducing sludge buildup thereon.

15 Claims, 7 Drawing Figures

FIG. 4
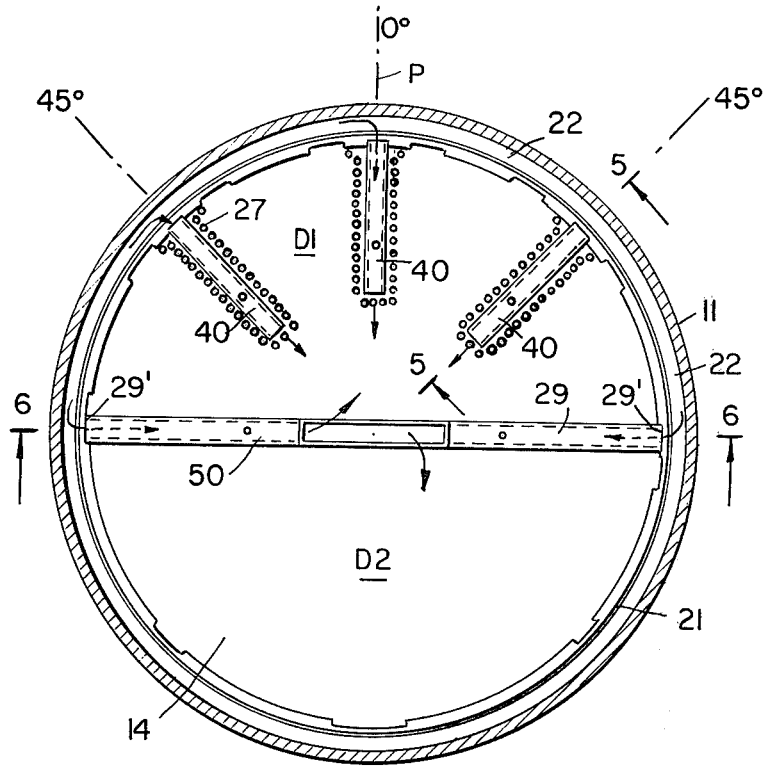
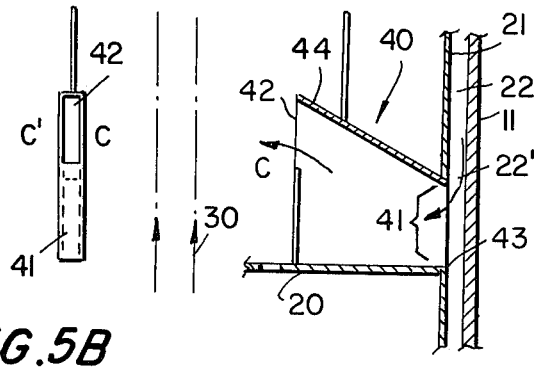
FIG. 5A
FIG. 5B
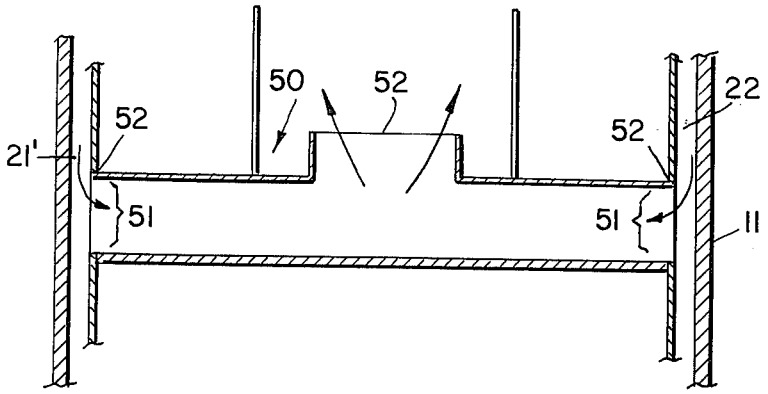
FIG. 6

HEAT EXCHANGERS

BACKGROUND OF THE INVENTION

The present invention relates to improvements in shell type heat exchangers, especially those utilized in the generation of steam by indirect heat exchange with a fluid circulating through a nuclear reactor. Devices of the type described herein must have adequate circulation of fluid throughout the heat exchange area in order to prevent thermal stress due to temperature irregularities, tube failure due to the concentration of corrosives within the exchanger and the phenomenon of dry spot formation in certain areas of the exchanger. Because heat exchangers of the type described herein have a highly concentrated U-tube arrangement, the circulation within the bundle of tubes may somteimes be impaired by the extreme density of the tubes present within the bundle. If makeup and downcomer fluids are introduced into the heat exchanger about its outer circumference then the circulation to the central portion of the heat exchanger is somewhat impaired by the tube bundle density. Sludge buildup on the upper surface of the tube sheet supporting the lower ends of the U-tubes not only inhibits the proper circulation of fluid but will eventually cause tube failure.

It is therefore an object of the present invention to provide improvements in heat exchangers for promoting circulation of the fluids therein.

It is another object of the present invention to provide means for promoting the natural circulation within a heat exchanger both in the radial and axial directions.

It is yet another object of the present invention to provide for the elimination of sludge buildup with the exchanger.

It is yet another object of the present invention to provide a system for reducing the possibility of tube failure in a heat exchanger.

It is another object of the present invention to provide improvements in the operation and maintenance of a heat exchanger such that its useful life is enhanced and its efficiency is increased.

SUMMARY OF THE INVENTION

There has been provided an improved heat exchanger for generating steam comprising a shell with inlet and outlet ports for water and steam respectively, an annular downcomer shell deposed adjacent to the inner walls of the shell for permitting natural circulation through openings therein, and a U-tube bundle and tube sheet therefor having opposed inlets and outlets for primary heating fluid, the improvement comprising an arrangement of the U-tube bundle such that at intervals about the periphery of the bundle, the tube density is reduced such that lanes are formed extending a selected distance within the bundle so that natural circulation through the openings of the annular downcomer is increased towards that portion of the bundle somewhat removed from the openings. Further improvements include the provision for ducts communicating with certain ones of the openings in the annular shell for promoting natural circulation in upper portions of the tube bundle arrangement. A torus header is provided which has nozzles which communicate with the interior of the heat exchanger to direct makeup water towards the upper surface of the tube sheet and reduce the amount of sludge buildup thereon.

For a better understanding of the present invention, together with other and further objects thereof, reference is directed to the following description taken in connection with the accompanying drawings while its scope will be pointed out in the appended claims.

DESCRIPTION OF THE DRAWINGS

FIG. 4 is a cross-section of an upper portion of the heat exchanger taken along line 4—4 illustrating the positioning ducts of the present invention;

FIGS. *5a–5b* are respective side and frontal views of the ducts shown in FIG. 3; and FIG. 6 is a side view of one specific duct illustrated in FIG. 4.

DESCRIPTION OF THE PREFERRED EMBODIMENT

Figure 1:
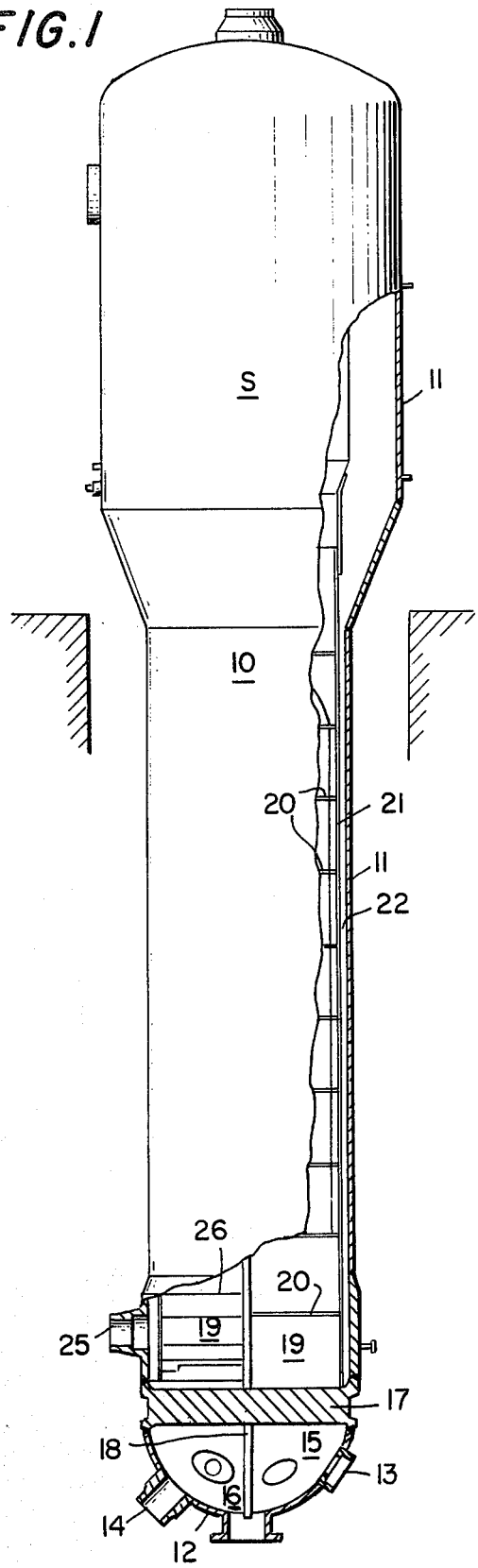
FIG. 1 is a fragmented side view of a heat exchanger incorporating the improvements of the present invention.

In FIG. 1 there is illustrated a fragmented side view of the heat exchanger of the present invention incorporating certain improvements therein. The heat exchanger 10 includes a generally cylindrical outer shell 11 which includes a header section 12 having inlet and outlet ports 13 and 14 respectively. The inlet 13 communicates with an inlet header chamber 15 and similarly the outlet 14 communicates with outlet header chamber 16. A tube sheet 17 defines a boundary for the header chambers 15 and 16 respectively with a vertical wall 18 separating one from the other. The tube sheet 17 has holes drilled therein whch are shown in detail in FIG. 3 discussed further therein. The tube sheet is fitted with a plurality of tubes shown schematically at reference 19, and in further detail in FIG. 2. The tubes are U-shaped and are fitted into the tube sheet holes in a conventional manner. Supports 20 (FIG. 2) serve to maintain alignment of the tubes and are displaced from the tube sheet in parallel horizontal planes. The supports 20 are sheets having holes therein for receiving the tubes with adjacent openings for permitting the flow of fluids upwardly therethrough as well as permitting the escape of generated steam discussed further herein. The heat exchanger has an annular shell 21 disposed therein and concentric with the outer shell 11. A space 22 is defined between the outer shell 11 and the annular shell 21, the space for permitting the flow of downcomer fluids from the upper portion of the heat exchanger in natural circulation.

The exchanger of the present invention operates such that a primary fluid is conducted through the tubes 19 through the inlet 13 and tube sheet 17. This fluid can be a primary moderating fluid, either ordinary water or pressurized heavy water ($D_2O$), for a nuclear reactor which is in indirect heat exchanger with a secondary fluid, water ($H_2O$) within the heat exchanger shell 11. The heat from the primary fluid causes the generation of steam within the shell 11 which is driven upwardly within the exchanger to area S shown in FIG. 1 for separation and drying. Separation of steam and water occurs in upper drum 11, with water returning downward through downcomer area 22. The annular shell 21 has openings 23 wherein the downcomer fluid in the space 22 may circulate into the bundle of tubes 19 as indicated by the arrows 24.

An inlet is provided for makeup water at 25 and an economizer or preheat section 26 is provided for preheating the makeup water communicated through the inlet 25.

Figure 3:
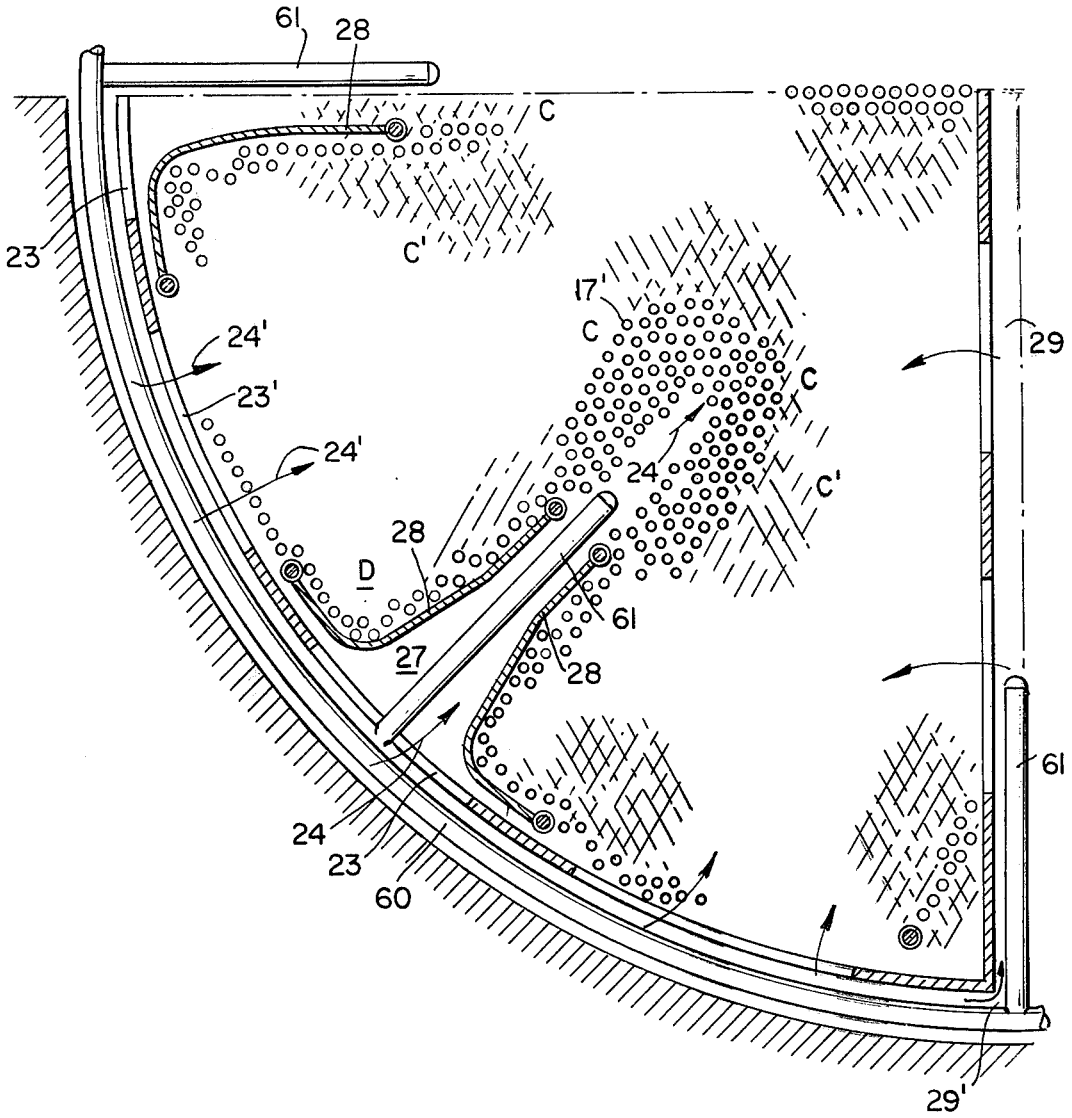
FIG. 3 is a cross-sectional view of one quadrant of the tube sheet along line 3—3 illustrating the concepts of the present invention.

In FIG. 3 there is shown a cross-sectional view of the tube sheet 17 in one quadrant. Normally the tube sheet would have a uniform density of holes 17, however, the arrangement and layout of the tube sheet holes 17' and consequentially the tubes 19 in the heat exchanger are arranged so that portions of the tube sheet layout have a reduced density of tubes such that a number of lanes 27 are provided. These lanes permit the flow of downcomer fluid 24 to pass through the openings 23 in the annular shell 21 so that the more centrally located tubes noted generally at C and C' receive an adequate supply of secondary fluid. Detector plates 28 direct the flow of downcomer fluid 24 inwardly of the tube bundle 19. The detector plates 28 direct the flow of the downcomer fluid 24 to area C-C' while the downcomer fluid may reach the area D through openings 23' adjacent plates 28 in the shell 21 as shown by the arrows 24'. The better circulation provided by the tube sheet arrangement of the present invention therefore eliminates much of the problems which exist in such a heat exchanger which are produced by inadequate supplies of secondary fluid in different areas thereof. The lanes 27 are shown as being uniformly spaced radially about each half of the tube sheet with a center channel 29. The radial lanes 27 may be nonuniformly disposed if desired, but the present layout is preferred.

The heat exchanger of the present invention and the tube layout as detailed in FIG. 4 illustrates that the inlet and outlet sections of the heat exchanger are separated back-to-back D-shaped sections, D1 and D2, respectively. The sections are separated by the transverse channel 29 which receives downcomer fluid through openings 29' as illustrated by the arrows 29'. This further provides for increased circulation to the portion of the exchanger which is somewhat displaced from the downcomer annular space 22. In the preferred embodiment there are three lanes 27 for each D section disposed uniformly at 0° and ± 45° relative to a perpendicular P with the center channel 29.

The present invention therefore provides a much more uniform circulation of fluids through the tube bundle with the attendant benefits of reduced concentrations of corrosives in portions of the exchanger where circulation is poor. Further, dry spots are virtually eliminated which if left unchecked will eventually cause tube failures. Repair of the heat exchanger caused by failure of the tubes requires a major effort to correct.

Further illustrations of the improved circulation provided by the present invention is shown in FIGS. 2, 4, 5*a*, 5*b*, and 6. In FIG. 4 the upper portion of the heat exchanger is shown taken along line 4—4 of FIG. 2 wherein ducts 40 and 50 are illustrated.

Figure 2:
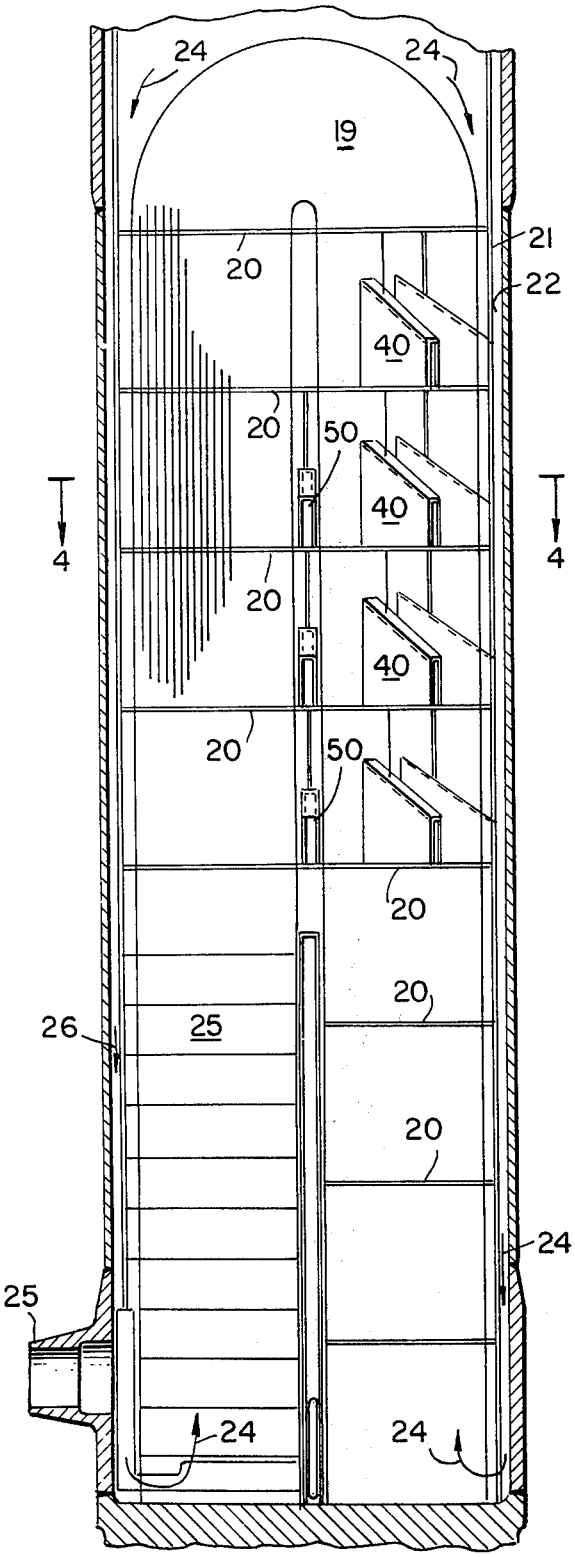
FIG. 2 is a cross-sectional view of a portion of the heat exchanger along line 2—2.

The ducts 40 are partially enclosed structures whch rest on the tube supports 20 in the lane area 27 as illustrated in FIG. 2. The duct 40 detailed in FIGS. 5*a* and 5*b* has two openings, an inlet and outlet 41 and 42, respectively. The inlet is in communication with an opening 43 in the annular shell 21 and the outlet 42 is in heat exchanger bundle 19. A top 44 is slanted upwardly from the shell 21 towards the center of the bundle 19 for directing the flow of the downcomer fluid 22'. It should be understood that the heat exchanger is generating steam and it is imperative that steam not escape into the downcomer annular opening 22. Therefore, the ducts 40 are designed so that the downcomer fluid may only escape inwardly of the heat exchanger bundle 19 whereas steam flow illustrated by the arrows 30 is restricted from flowing into the annular space 22. This one-way flow configuration promotes circulation of downcomer fluid into the central portion C-C' of the tube nest 19 while preventing deleterious effects to natural circulation by backflow of steam. The ducts 40 are installed at the various levels 20 illustrated in FIG. 1 so that the upper portions of the tube bundle 19 receive adequate supplies of heat exchanger fluid throughout, thereby providing a more uniform communication of fluids in the tube bundle 19.

In another feature of the present invention, a side view of duct 50 is shown in FIG. 6. This duct 50 is similar in nature and function to the duct 40 of FIGS. 5*a* and 5*b* except that this duct is installed at the various levels 20 in the central channel 29 as illustrated in FIGS. 2 and 4. This duct has a symmetrical shape with openings 51 in communication with openings 52 in the downcomer annular shell 21.

The duct 50 communicates downcomer fluid 22' through the openings 51 and outwardly through the outlet opening 52 thereof. This communicates sufficient amounts of downcomer fluid at various levels 20 in the central channel 29 for promoting the adequate circulation as explained previously.

The ducts 40 and 50 are closed at the bottom since they rest on the tube supports 20, permitting only an exit of downcomer fluid 22' while preventing the backflow of steam into the downcomer annular space 22.

A further refinement of the present invention is the utilization of makeup water from other sources, perhaps reheat condensate from turbines driven by the steam generated by the exchanger 10 or other processes driven by the available energy of the steam generator 10. A toroidal header 60 shown fragmented in FIG. 3 has nozzles 61 communicating therewith, which nozzles 61 pass through the shell 11 and through the openings 24 in the annular downcomer channel so that the nozzles 61 are in communication with the lanes 27 and central channel 29. The nozzles are directed so as to provide a stream of water under pressure over the top surface of the tube sheet 17. This makeup water is supplied not only for the purpose of providing adequate secondary fluid to the heat exchanger, but also for the purpose of providing a means for cleaning the bottom of the exchanger where sludge builds up. This cleaning action prevents the difficulties associated with corrosion, thermal stresses, dry spots and insulation of the tubes from the secondary fluid, the elimination of efficient operation of which promotes a more efficient of the heat exchanger and increases its useful life. Furthermore, the makeup water provided through the toroidal header 60 and nozzles 61 may be utilized to promote further circulation of the fluids within the heat exchanger in a somewhat modified force circulation configuration.

The improvements of the present invention therefore serve to promote the more uniform circulation of the fluids throughout the heat exchange area of a steam generating system so that the overall efficiency of the apparatus is enhanced, the useful life is increased and the maintenance factor is reduced.

While there has been described what at present is considered to be the preferred embodiment of the present invention, it will be obvious to those skilled in the art that certain changes may be made therein, and it is intended in the accompanying claims, to cover all such changes and modifications as fall within the true spirit and scope of the invention.

What is claimed is:

1. An improved heat exchanger comprising; a shell with an inlet for water and an outlet for steam, an annular downcomer shell disposed adjacent to the inner wall of the shell for permitting natural circulation in an area defined between the shell and the annular downcomer through openings therein, and a U-tube bundle and tube sheet therefor having opposed inlets and outlets for primary heating fluid, the improvement comprising:

an arrangement of the U-tube bundle such that at intervals about the bundle the tube density is reduced such that lanes are formed extending a selected distance within the bundle of tubes so that the natural circulation through the openings of the annular downcomer is increased towards that portion of the bundle somewhat removed from the openings.

2. The improved heat exchanger of claim 1 further including duct means disposed in the lanes communicating with openings in the annular downcomer to conduct a portion of the downcomer water to the interior upper levels of the tube bundle.

3. The improved heat exchanger of claim 1 further including header means and nozzles therefor for delivering fluid to the heat exchanger tube bundle through openings in the heat exchanger shell, said nozzles extending into the lanes for delivering makeup water and providing turbulence for cleaning the upper surface of the tube sheet of the heat exchanger.

4. The improved heat exchanger of claim 1 wherein the U-tubes and tube sheet are arranged as back-to-back D sections with a central channel separating the Ds and the improvements further including plate means disposed along the portion of the lanes adjacent the openings in the annular downcomer and tube sheet extending into the lanes for smoothing the path of the downcomer water into the lanes.

5. The improved heat exchanger of claim 4 wherein the annular downcomer shell extends within said center channel of the D sections, and has openings for conducting fluid into the center of the bundle along the straight portion of the D.

6. The improved heat exchanger of claim 4 wherein plates extend upwardly for coinciding with the openings of the annular downcomer and laterally beyond said opening.

7. The improved heat exchanger of claim 2 wherein support means having openings therein for the tubes and water passageways therein conform to the layout of the tube, the sheet and duct means comprises a member having a rectangular cross-section disposed to rest on the support in the areas coinciding with the lanes with an opening communicating with the openings in the annular shell and another opening conducted toward the center of the bundle disposed higher than the first mentioned opening for permitting downcomer water into the bundle but preventing steam formations within the heat exchanger from escaping into the downcomer area.

8. The improved heat exchanger of claim 2 wherein the duct means comprises a conduit having at least two openings one higher than the other, the lower one mating with the opening of the annular downcomer for receiving downcomer water therethrough and the upper opening directing the flow of said downcomer water into the central area of the bundle.

9. The improved heat exchanger of claim 8 wherein the duct has openings disposed concentrically relative to the side walls of the annular member and walls extending radially of the bundle with upwardly angled upper top edges, a top therefor the lower opening mating with the corresponding opening of the annular wall and being sized therefor the uppermost opening having a similar size and a wall adjoining the sides below the opening.

10. The improved heat exchanger of claim 9 wherein the radial walls of the ducts resemble trapezoidal structures with at least one right rectangular edge resting on the tube support floor within the lane area generally.

11. The improved heat exchanger of claim 4 wherein a duct is formed for disposition in the channel separating the Ds having an inverted T cross-section, the duct being an enclosed channel with openings at each end of the extremities of the T and mating with corresponding openings in the annular shell to conduct downcomer fluid into the duct and out the remaining opening into the central area of the bundle.

12. The improved heat exchanger of claim 11 wherein the central opening of the duct is higher than the extreme openings for preventing the formation of steam within the generator from escaping into the downcomer area.

13. The improved heat exchanger of claim 3 wherein the header means is a toroidal member with the nozzles extending therefrom radially in correspondence with the lanes and the center channel so as to provide makeup water to the heat exchanger, and provide for increased circulation and cleaning thereof.

14. The improved heat exchanger of claim 4 wherein three lanes are formed in each D section of the tube sheet at uniform angular displacements from each other and the center channel.

15. The improved heat exchanger of claim 14 wherein the three lanes are disposed in each D section at about 0° and ± 45° relative to a perpendicular to the center channel.

* * * * *